US010442201B2

(12) United States Patent
Ibe et al.

(10) Patent No.: US 10,442,201 B2
(45) Date of Patent: Oct. 15, 2019

(54) METHOD FOR MANUFACTURING LIQUID EJECTION HEAD

(71) Applicant: CANON KABUSHIKI KAISHA, Tokyo (JP)

(72) Inventors: Satoshi Ibe, Yokohama (JP); Kenji Fujii, Yokohama (JP); Yusuke Hashimoto, Yokohama (JP); Shuhei Oya, Kawasaki (JP); Hirohisa Fujita, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/965,029

(22) Filed: Apr. 27, 2018

(65) Prior Publication Data

US 2018/0319165 A1 Nov. 8, 2018

(30) Foreign Application Priority Data

May 2, 2017 (JP) ..... 2017-091879

(51) Int. Cl.
*B41J 2/16* (2006.01)

(52) U.S. Cl.
CPC ..... *B41J 2/162* (2013.01); *B41J 2/1603* (2013.01); *B41J 2/1628* (2013.01); *B41J 2/1629* (2013.01); *B41J 2/1631* (2013.01); *B41J 2/1635* (2013.01); *B41J 2/1639* (2013.01)

(58) Field of Classification Search
None
See application file for complete search history.

(56) References Cited

U.S. PATENT DOCUMENTS

2007/0212890 A1* 9/2007 Sakai ..... B41J 2/1603 438/733

FOREIGN PATENT DOCUMENTS

| | | | |
|---|---|---|---|
| JP | 2004090573 | A | 3/2004 |
| JP | 2012200916 | A | 10/2012 |
| JP | 2012240208 | A | 12/2012 |

* cited by examiner

*Primary Examiner* — Jiong-Ping Lu
(74) *Attorney, Agent, or Firm* — Canon U.S.A., Inc. IP Division

(57) ABSTRACT

A method for manufacturing a liquid ejection head includes: a step of preparing a substrate having a first surface on which energy generation elements and a first layer are provided; and a step of forming a supply port by etching the substrate with an etching liquid or an etching gas from a second surface which is a surface opposite to the first surface so as to enable the etching liquid or the etching gas to reach the first layer, and the first layer is divided by a region which is located between a portion of the first layer covering the energy generation elements and a portion of the first layer to which the etching liquid or the etching gas is reached.

10 Claims, 5 Drawing Sheets

METHOD FOR MANUFACTURING LIQUID EJECTION HEAD

BACKGROUND

Field of the Disclosure

The present disclosure relates to a method for manufacturing a liquid ejection head.

Description of the Related Art

As a liquid ejection head used for an ink jet recording apparatus or the like, a liquid ejection head having a substrate in which a supply port supplying a liquid is penetrated has been known. The supply port as described above is formed in such a way that after an etching stop layer is formed on a surface of the substrate, the substrate is etched from a rear surface opposite to the above surface with an etching liquid or an etching gas. In the case described above, when a crack is generated in the etching stop layer during the etching, the etching liquid or the etching gas may penetrate to the surface of the substrate, and as a result, energy generation elements and the like provided at a surface side may be adversely influenced in some cases.

Japanese Patent Laid-Open No. 2012-240208 has disclosed a method in which since a protective layer is formed on an etching stop layer, an adverse influence on a substrate surface side caused by a crack generated in the etching stop layer is suppressed.

However, in the method disclosed in Japanese Patent Laid-Open No. 2012-240208, for example, when a film stress of the etching stop layer is high, or when the etching time is increased, an etching liquid or an etching gas may penetrate to a substrate surface side in some cases. In addition, when a layer covering energy generation elements is formed to extend to a region in which an supply port is formed, a crack generated in the vicinity of the region in which the supply port is formed extends to the vicinity of the energy generation elements, and as a result, the energy generation elements may be adversely influenced by the etching liquid or the like.

SUMMARY

The present disclosure provides a method for manufacturing a liquid ejection head which includes a substrate in which a supply port supplying a liquid is penetrated, energy generation elements each of which generates energy ejecting the liquid, a first layer covering the energy generation elements, and an ejection port member in which ejection ports each of which ejects the liquid are formed, the energy generation elements, the first layer, and the ejection port member being provided on a first surface of the substrate, the method comprising: a step of preparing the substrate having the first surface on which the energy generation elements and the first layer are provided; and a step of forming the supply port by etching the substrate with an etching liquid or an etching gas from a second surface which is a surface opposite to the first surface so as to enable the etching liquid or the etching gas to reach the first layer. In addition, the first layer is divided by a region which is located between a portion of the first layer covering the energy generation elements and a portion of the first layer to which the etching liquid or the etching gas is reached.

Further features of the present disclosure will become apparent from the following description of exemplary embodiments with reference to the attached drawings.

DESCRIPTION OF THE EMBODIMENTS

Figure 1:
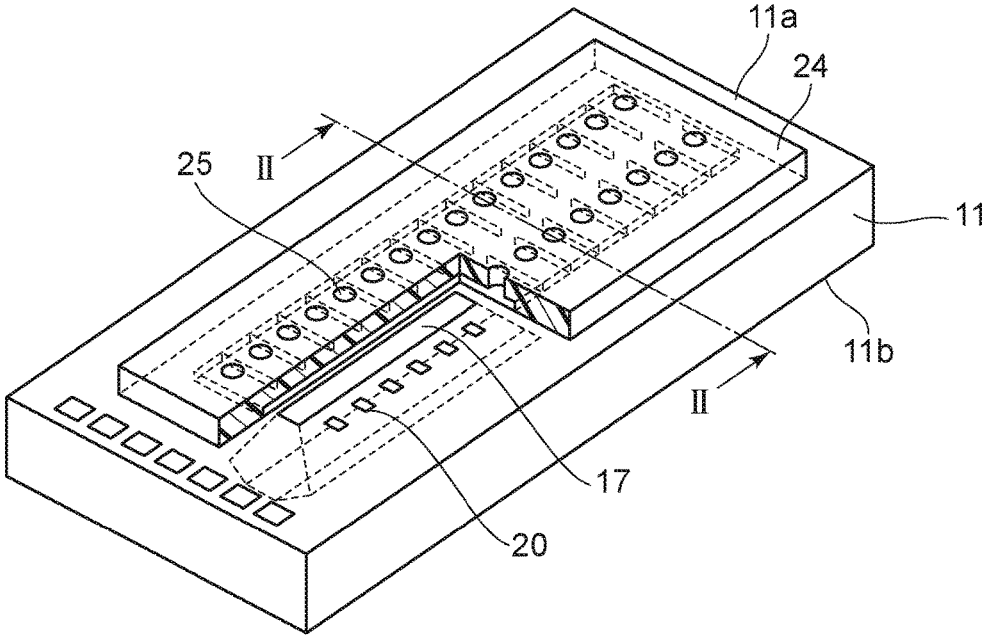
FIG. 1 is a perspective view of a liquid ejection head, according to one or more embodiments of the subject disclosure.

Accordingly, when a supply port is formed in a substrate with an etching liquid or an etching gas, the present disclosure aims to preferably suppress an adverse influence on a surface side of a substrate caused by penetration of an etching liquid or an etching gas to the surface side of the substrate.

Hereinafter, an embodiment carrying out the present disclosure will be described with reference to the drawings. In addition, in the following explanation, constituent elements having the same function are designated by the same reference numeral, and description thereof may be omitted in some cases.

FIG. 1 is a perspective view of a liquid ejection head. The liquid ejection head includes a substrate 11 in which a supply port 17 supplying a liquid is penetrated and an ejection port member 24 in which ejection ports 25 ejecting the liquid are formed. The ejection port member 24 is formed on a first surface 11*a* of the substrate 11. Furthermore, on the first surface 11*a*, energy generation elements 20 generating energy to eject the liquid are formed. The supply port 17 penetrates the substrate 11 and communicates the first surface 11*a* of the substrate 11 with a second surface 11*b* which is a surface opposite to the first surface 11*a*. The liquid is supplied to a first surface 11*a* side from a second surface side 11*b* side through the supply port 17 and is ejected from the ejection ports 25 by energy applied by the energy generation elements 20. As described above, for example, recording of images and/or letters is performed.

A method for manufacturing a liquid ejection head of the present disclosure will be described with reference to FIGS. 2A to 2F. FIGS. 2A to 2F are cross-sectional views of the liquid ejection head shown in FIG. 1 which are taken along the line II-II and which show steps of manufacturing the liquid ejection head in this order.

Figure 2A:
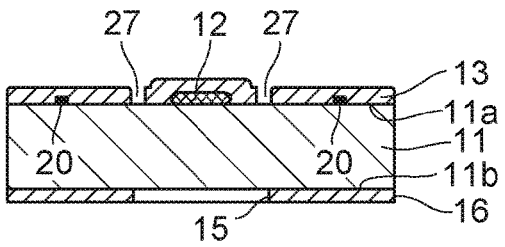
FIGS. 2A to 2F are cross-sectional views each showing a method for manufacturing a liquid ejection head, according to one or more embodiments of the subject disclosure.

First, a substrate as shown in FIG. 2A is prepared. The energy generation elements 20, a sacrifice layer 12, and a first layer 13 covering the sacrifice layer 12 and the energy generation elements 20 are provided on the first surface 11*a* of the substrate 11. Wires not shown in the figure are connected to the energy generation elements 20. In addition, the first layer 13 is omitted in FIG. 1. On the second surface 11*b* which is a surface opposite to the first surface 11*a*, a mask layer 16 having an opening 15 is provided. The mask layer 16 is also omitted in FIG. 1.

The sacrifice layer 12 is a layer defining an opening width of the supply port at the first surface 11*a* side and is a layer having an etching rate higher than that of the substrate 11. The substrate 11 is formed, for example, of single crystal silicon, and the sacrifice layer 12 is formed of poly-Si, Al, Al—Si, or the like. Although the sacrifice layer 12 is not always required to be provided, when the sacrifice layer 12 is provided, the opening width of the supply port can be controlled by the width of the sacrifice layer 12, and hence, the opening width of the supply port is stabilized.

The first layer 13 covers the energy generation elements 20 and the sacrifice layer 12. The energy generation elements 20 are each formed, for example, of TaSiN. Since being covered with the first layer 13, the energy generation elements 20 are protected from ink and/or the like. As a material of the first layer 13, for example, SiN, SiC, or SiCN may be mentioned. The first layer 13 may also be used as an insulating layer. In addition, as described above, the first layer 13 is a layer also covering the sacrifice layer 12. The sacrifice layer 12 is formed on a region in which the supply port is to be formed. Hence, the first layer 13 is present on the region in which the supply port is to be formed. In addition, the first layer 13 functions as an etching stop layer for an etching liquid or an etching gas to be used for the formation of the supply port.

The first layer 13 is divided by a region 27 which is located between a portion of the first layer 13 on the energy generation elements 20 and a portion of the first layer 13 on the region in which the supply port is to be formed. The region 27 is a region (space) in which the first layer 13 is not present and is a groove at the stage shown in FIG. 2A.

Figure 2D:
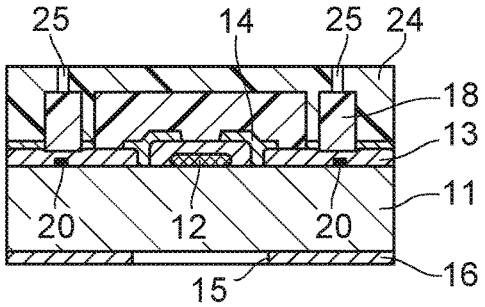
Figure 2B:
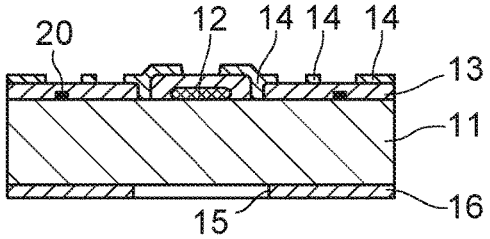

Next, as shown in FIG. 2B, a second layer 14 is formed so as to fill the region 27. In this step, the second layer 14 also functions to increase an adhesive force between the substrate and the ejection port member which is to be formed later. Hence, the second layer 14 is patterned so that a portion filling the region 27 and another necessary portion are allowed to remain. FIG. 2B shows the state obtained after the second layer 14 is patterned. The second layer 14 is formed, for example, from a poly(ether amide) and is then patterned by dry etching.

Figure 2E:
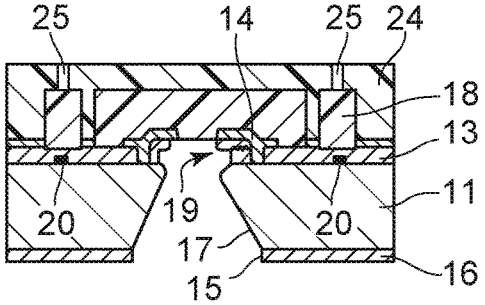
Figure 2C:
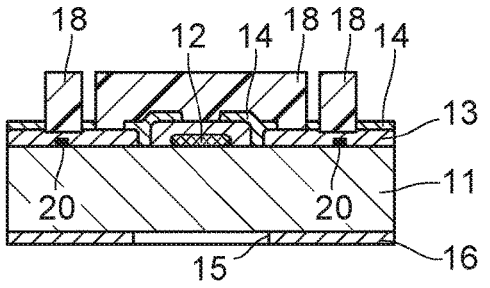

Next, as shown in FIG. 2C, a flow path-mold material 18 is formed on the first surface. The mold material 18 is formed, for example, from aluminum or a photosensitive resin. In particular, as the photosensitive resin, a positive type photosensitive resin is preferably used. For example, after a composition containing a positive type photosensitive resin is applied on the first surface, patterning with exposure and development is performed by a photolithography to form a flow path-shape, so that the mold material 18 is formed.

Next, as shown in FIG. 2D, the ejection port member 24 is formed. For example, a composition containing a negative type photosensitive resin is applied to cover the mold material 18. The composition thus applied is patterned by a photolithography, so that the ejection ports 25 are formed. As described above, from the composition containing a negative type photosensitive resin, the ejection port member 24 is formed.

Next, as shown in FIG. 2E, the supply port 17 is formed in the substrate 11. In this case, an example in which the substrate 11 is a single crystal silicon substrate and is to be anisotropically etched with an etching liquid will be described. First, from the opening 15 of the mask layer 16 provided at the second surface side of the substrate 11, the etching liquid is allowed to intrude into the substrate 11. As the etching liquid, for example, tetramethylammonium hydroxide (TMAH) or potassium hydroxide (KOH) may be mentioned. When the substrate is progressively etched with the etching liquid, and this etching liquid reaches the first surface, the sacrifice layer 12 is then etched. The sacrifice layer 12 is immediately etched, and the etching liquid reaches the first layer 13.

Subsequently, the supply of the etching liquid is stopped at an appropriate timing. Finally, a portion of the first layer 13 provided on the sacrifice layer 12 is removed. This removal of the first layer 13 is performed, for example, by dry etching. FIG. 2E is a view showing the state in which the first layer 13 located on the sacrifice layer 12 is removed.

In this step, in the first layer 13, a crack 19 is generated. This crack 19 may be generated by various factors, such as a film stress of the first layer 13 functioning as the etching stop layer. When the crack 19 is generated in the first layer 13, the etching liquid reaches the first surface side (front surface side) from the second surface side (rear surface side) of the substrate through the crack 19. Since the first layer 13 is also provided on the energy generation elements 20, an adverse influence (such as the change in shape and/or characteristics) on the energy generation elements 20 may be generated by the etching liquid in some cases.

On the other hand, according to the present disclosure, between the portion of the first layer 13 covering the energy generation elements 20 and the portion of the first layer 13 to which the etching liquid is reached, the region dividing the first layer 13 is present. In FIG. 2E, the second layer 14 is filled in this region 27. Hence, even when being generated in the portion of the first layer 13 to which the etching liquid is reached, the crack 19 can be suppressed from extending onto the energy generation elements 20. When the region 27*b* is filled with the second layer 14, the second layer 14 suppresses the penetration of the etching liquid through the crack 19. Hence, although the region 27 is preferably filled with the second layer 14, even if the region 27 is not filled with the second layer 14, the crack 19 is once stopped by the region 27. That is, an extension of the crack 19 can be suppressed. That is, even in the case in which the second layer 14 is not filled in the region 27, and the region 27 is only a space, compared to the case in which the region 27 is not provided, the penetration of the etching liquid can be suppressed.

Figure 2F:
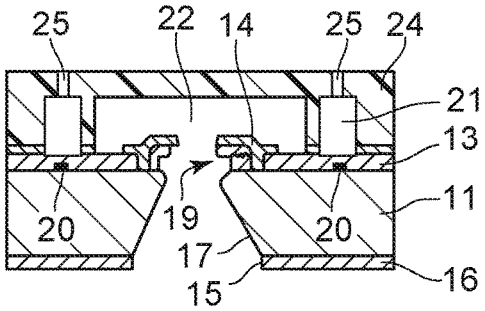

After the supply port 17 is formed, as shown in FIG. 2F, flow paths 21 are formed by removing the mold material 18. Finally, if needed, for example, curing of the ejection port member 24 by heating and electrical connection of the energy generation elements 20 are performed, so that the liquid ejection head is manufactured.

Figure 3A:
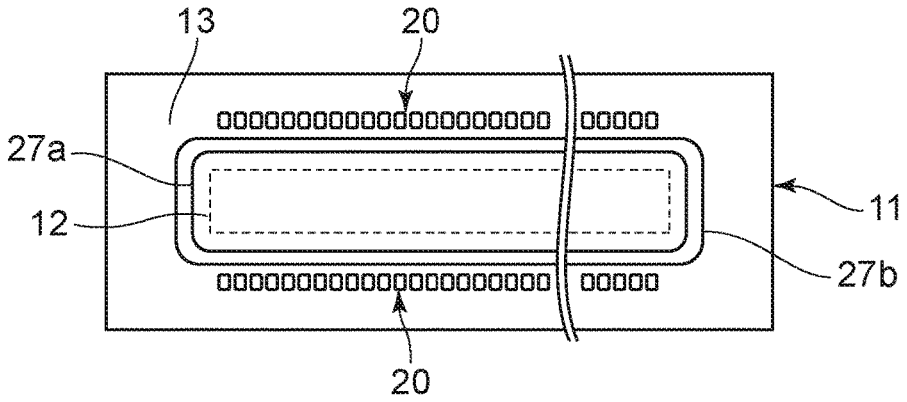
FIGS. 3A and 3B are plane views each showing a substrate of the liquid ejection head, according to one or more embodiments of the subject disclosure.
Figure 3B:
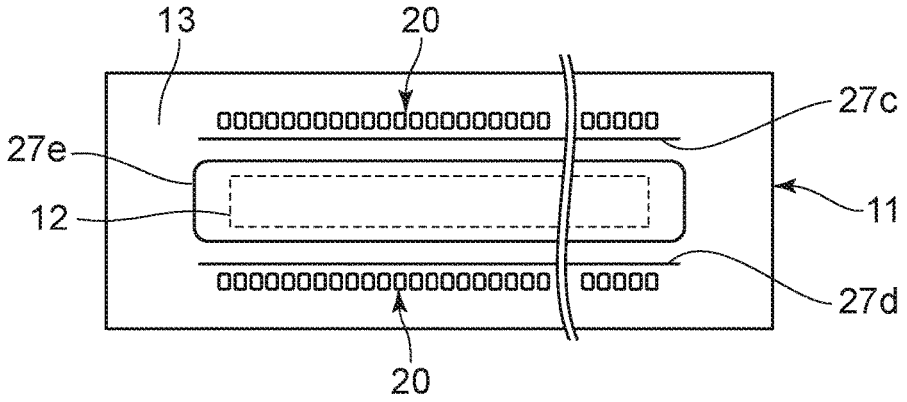

In each of FIGS. 3A and 3B, the state of the substrate 11 in FIG. 2D viewed from the above is shown which is obtained after the mold material 18 and the ejection port member 24 are omitted. In FIG. 3A, a region 27*a* is provided so as to surround the sacrifice layer 12, that is, a portion (hereinafter, referred to as "opening portion") in which the supply port is to be opened. The opening portion may also be called a portion to which an etching liquid or an etching gas passing through the substrate is to be reached. Since the region 27*a* surrounds the opening portion, even if a crack is generated in an arbitrary direction, the etching liquid can be suppressed from penetrating to the first surface side. A region 27*b* is further provided outside the region 27*a*, so that a double structure is formed. As described above, since a plurality of the regions surrounds the opening portion, the penetration of the etching liquid is further suppressed.

In FIG. 3B, a region 27*e* surrounds the opening portion, and a region 27*c* and a region 27*d* are provided to extend between the region 27*e* and the energy generation elements 20. By the arrangement as described above, the penetration of the etching liquid can also be suppressed. Without forming the region 27*e*, the region 27*c* and the region 27*d* may only be provided.

Figure 4A:
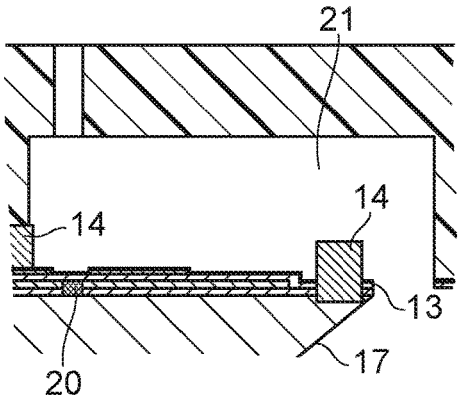
FIGS. 4A to 4F are cross-sectional views each showing the liquid ejection head, according to one or more embodiment of the subject disclosure.
Figure 4D:
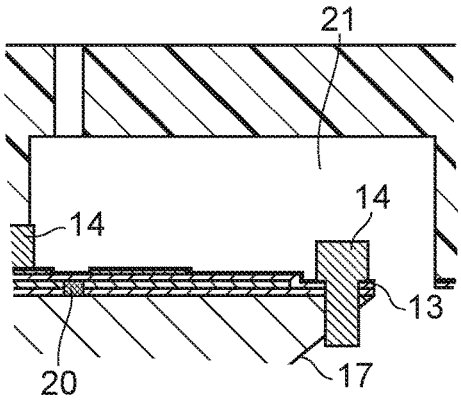
Figure 4B:
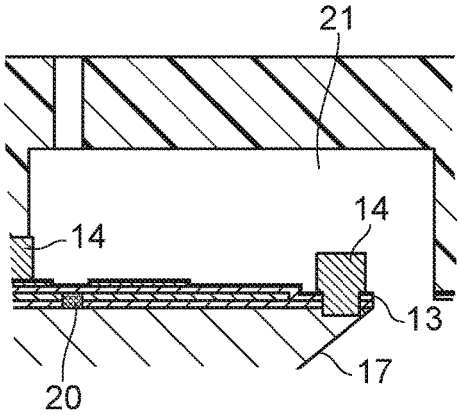

In FIGS. 2B to 2F, the second layer 14 is also provided on the first layer 13 formed on the sacrifice layer 12. However, besides the structure as described above, as shown in FIG. 4A, the second layer 14 may not be provided on the first layer 13 formed on the sacrifice layer 12. Other patterns except the pattern in FIG. 4A are shown in FIG. 4B to 4F. In FIG. 4B, the width of the second layer 14 is large at an upper portion as compared to that thereof buried in the first layer 13. In the case described above, an area at which the second layer 14 and the first layer 13 are in close contact with each other is increased, and the second layer 14 is not likely to be peeled away from the first layer 13.

Figure 4E:
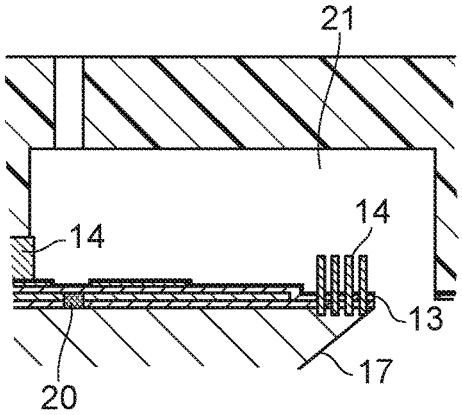
Figure 4C:
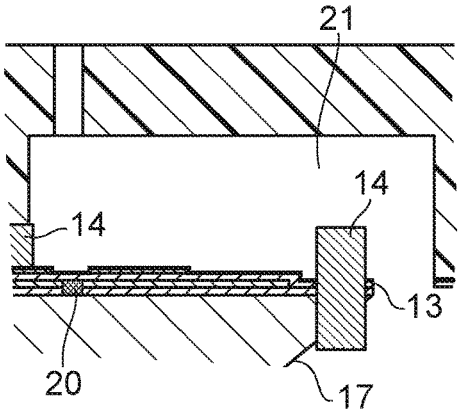
Figure 4F:
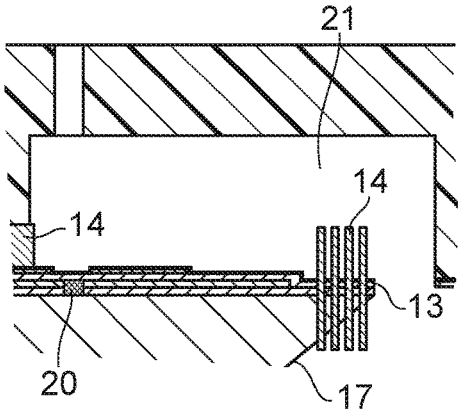

In FIG. 4C, the second layer 14 penetrates the substrate, and the second layer 14 is projected to the supply port 17. FIG. 4D shows the state in which the second layer 14 having the shape shown in FIG. 4B is projected to the supply port 17. In FIG. 4E, the second layer 14 has a multilayer structure, and in FIG. 4F, the second layer 14 in FIG. 4E is projected to the supply port 17. As shown in FIGS. 4C, 4D, and 4F, when the second layer 14 is projected to the supply port 17, first, a hole in which the second layer 14 is to be formed is provided in the substrate. Since this hole is finally formed as a through-hole, even if, for example, the etching rate is not stabilized to a certain extent when the hole is formed, the depth of the hole is likely to be controlled. In addition, as shown in FIGS. 4E and 4F, when the second layer 14 is formed to have a multilayer structure, a penetration path of an etching liquid or an etching gas is complicated, and as a result, the penetration of the etching liquid can be further suppressed as described above.

Figure 5A:
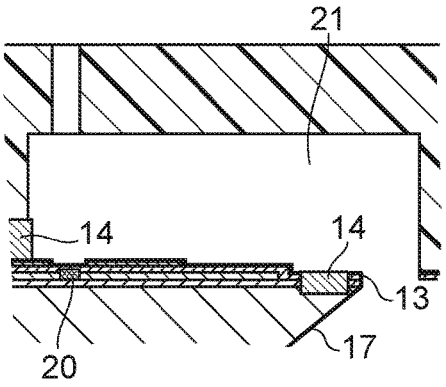
FIGS. 5A to 5D are cross-sectional views each showing the liquid ejection head, according to one or more embodiment of the subject disclosure.
Figure 5C:
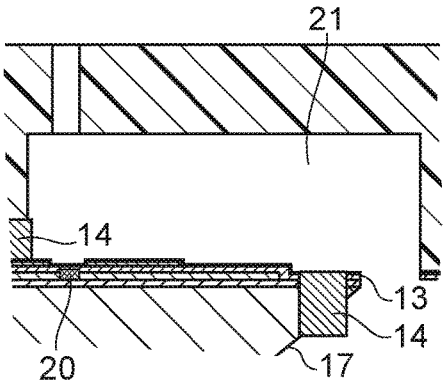
Figure 5B:
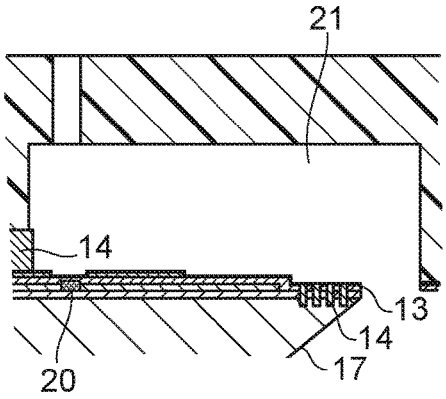
Figure 5D:
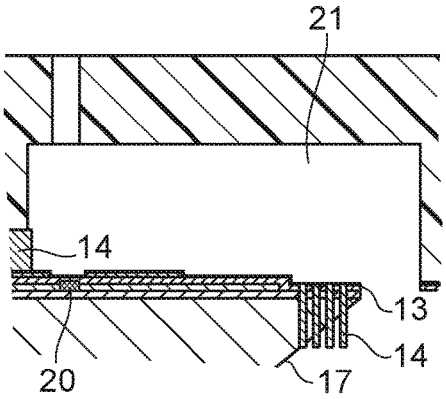

In the examples described with reference to FIGS. 4A to 4F, the second layer 14 is projected into the flow path 21. Hence, the flow of the liquid to be supplied to the energy generation elements 20 may be disturbed by the projected second layer 14 in some cases. On the other hand, in FIG. 5A, the second layer 14 is suppressed as much as possible from being projected. In particular, the second layer 14 is formed at a position lower than that of the first layer 13 formed on the sacrifice layer 12. Even in the state as described above, as shown in FIGS. 5B to 5D, the second layer 14 may be formed to have a multilayer structure and/or may be projected to the supply port 17.

Heretofore, the penetration of the etching liquid which is caused when the supply port 17 is formed using the etching liquid has been primarily described. However, the supply port 17 may also be formed by dry etching, such as reactive ion etching. In this case, although the penetration of an etching gas to the surface (first surface) of the substrate causes a problem as is the case of the etching liquid described above, the penetration of the etching gas can also be suppressed by the presence of the region 27 as described above.

EXAMPLES

Hereinafter, the present disclosure will be described in more detail with reference to examples.

Example 1

First, a substrate as shown in FIG. 2A was prepared. A substrate 11 was a single crystal silicon substrate having a thickness of 725 μm. On a first surface 11*a*, energy generation elements 20 each formed of TaSiN and a sacrifice layer 12 formed of Al—Si having a thickness of 400 nm were provided. Along a longitudinal direction of the sacrifice layer 12, 160 energy generation elements were provided with pitches of 600 dpi at one side (total 320 elements were provided at two sides). The widths in the longitudinal and the lateral directions of the sacrifice layer 12 in parallel to the first surface 11*a* were 150×8,000 (μm).

The sacrifice layer 12 and the energy generation elements 20 were covered with a first layer 13 formed of SiN having a thickness of 260 nm. The first layer 13 is divided by a region 27 located between a portion on the energy generation elements 20 and a portion on a region in which a supply port was to be formed. Wires not shown in the figure were connected to the energy generation elements 20. On a second surface lib which was a surface opposite to the first surface 11*a*, a mask layer 16 which was formed of $SiO_2$ having a thickness of 650 nm and which had an opening 15 was provided.

Next, a poly(ether amide) (HIMAL1200, manufactured by Hitachi Chemical Company, Ltd.) was applied onto the first layer 13 by spin coating and was then heated at 250° C. for 1 hour, so that a poly(ether amide) film having a thickness of 2 μm was formed. Patterning was performed on this poly(ether amide) film by oxygen plasma using a photoresist (THMR-iP5700 HP, manufactured by Tokyo Ohka Kogyo Co., Ltd.). As described above, as shown in FIG. 2B, the second layer 14 was formed from a poly(ether amide). The second layer 14 was filled in the region 27*b* by which the first layer 13 was divided.

Next, as shown in FIG. 2C, a positive type resist (ODUR, manufactured by Tokyo Ohka Kogyo Co., Ltd.) was applied on the first surface and was then patterned by a photolithography, so that a flow path-mold material 18 was formed.

Next, as shown in FIG. 2D, an ejection port member 24 was formed. First, a composition containing a negative type photosensitive resin having the following formation was applied so as to cover the mold material 18.

- Epoxy resin (EHPE, manufactured by Daicel Corporation) 100 parts by mass
- Additive resin (1,4-HFA8, manufactured by Central Glass Co., Ltd.) 20 parts by mass
- Silane coupling agent (A-187, manufactured by UNICA Corporation) 5 parts by mass
- Photocationic polymerization catalyst (SP170, manufactured by ADEKA Corporation) 2 parts by mass
- Methyl isobutyl ketone 50 parts by mass
- Diethylene glycol dimethyl ether 50 parts by mass Subsequently, the composition thus applied was exposed and developed to form ejection ports 25, and the ejection port member 24 was formed from the composition containing the negative type photosensitive resin.

Next, as shown in FIG. 2E, a supply port 17 was formed in the substrate 11. First, the ejection port member 24 was covered with a resin resist (OBC, manufactured by Tokyo Ohka Kogyo Co., Ltd.). Subsequently, etching of the substrate 11 was started from the opening 15 of the mask layer 16 provided at a second surface side of the substrate 11 using a TMAH aqueous solution (concentration: 22 percent by mass) as an etching liquid at 83° C. When the etching liquid progressively etched the substrate and reached the first surface, the sacrifice layer 12 was then etched, so that the etching liquid reached the first layer 13. Next, after the supply of the etching liquid was stopped, and the resin resist was removed, a part of the first layer 13 provided on the sacrifice layer 12 was further removed by dry etching.

Next, the mold material 18 was removed, and as shown in FIG. 2F, flow paths 21 were formed. Subsequently, the ejection port member 24 was heated, so that a chip for a liquid ejection head was manufactured. In one silicon wafer, 750 chips were manufactured. The chips were separated from the silicon wafer, and for example, electrical connections of the energy generation elements 20 were performed, so that the liquid ejection heads were each manufactured.

The state of the first layer 13 and that of the energy generation elements 20 of the liquid ejection head thus manufactured were observed using an electron microscope. As a result, although a chip in which a crack was generated in the first layer 13 in the vicinity of the supply port 17 was observed, an adverse influence on the energy generation elements 20 caused by the penetration of the etching liquid was not recognized.

Example 2

Except for that the second layer 14 was not provided, a liquid ejection head was manufactured by a method similar to that of EXAMPLE 1.

The state of a first layer 13 and that of energy generation elements 20 of the liquid ejection head thus manufactured were observed using an electron microscope. As a result, although a chip in which a crack was generated in the first layer 13 in the vicinity of a supply port 17 was observed, an adverse influence on the energy generation elements 20 caused by the penetration of an etching liquid was not recognized.

Comparative Example 1

Except for that the region 27 was not provided, a liquid ejection head was manufactured by a method similar to that of EXAMPLE 1.

The state of a first layer 13 and that of energy generation elements 20 of the liquid ejection head thus manufactured were observed using an electron microscope. As a result, a chip in which cracks were generated in the first layer 13 in the vicinity of a supply port 17 and the energy generation elements 20 were observed. There was recognized the change in shape of the energy generation element 20 which was believed to be caused by the penetration of an etching liquid.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-091879, filed May 2, 2017, which is hereby incorporated by reference herein in its entirety.

What is claimed is:

1. A method for manufacturing a liquid ejection head which includes:

a substrate in which a supply port supplying a liquid is penetrated, energy generation elements each of which generates energy ejecting the liquid, a first layer covering the energy generation elements, and an ejection port member in which ejection ports each of which ejects the liquid are formed, the energy generation elements, the first layer, and the ejection port member being provided on a first surface of the substrate, the method comprising:

a step of preparing the substrate having the first layer on which the energy generation element and the first layer are provided; and a step of forming the supply port by etching the substrate with an etching liquid or an etching gas from a second surface which is a surface opposite to the first surface so as to enable the etching liquid or the etching gas to reach the first layer, wherein the first layer is divided by at least one region which is located between a portion of the first layer covering the energy generation element and a portion of the first layer to which the etching liquid or the etching gas is reached, and wherein the liquid ejection head further includes a second layer filled in the region.

2. The method for manufacturing a liquid ejection head according to claim 1, wherein the first layer includes at least one of SiN, SiC, and SiCN.

3. The method for manufacturing a liquid ejection head according to claim 1, further comprising: a step of forming a sacrifice layer on the first surface of the substrate before the step of forming the supply port, wherein the sacrifice layer has an etching rate higher than that of the substrate.

4. The method for manufacturing a liquid ejection head according to claim 3, wherein the sacrifice layer includes at least one of poly-Si, Al, and Al—Si.

5. The method for manufacturing a liquid ejection head according to claim 3, wherein the first layer is provided on the sacrifice layer.

6. The method for manufacturing a liquid ejection head according to claim 1, wherein the second layer includes a poly(ether amide).

7. The method for manufacturing a liquid ejection head according to claim 1, wherein the second layer penetrates the substrate, and the second layer is projected to the supply port.

8. The method for manufacturing a liquid ejection head according to claim 1, further comprising:

a step of forming a sacrifice layer on the first surface of the substrate before the step of forming the supply port, wherein the sacrifice layer has an etching rate higher than that of the substrate, the first layer is provided on the sacrifice layer, and the second layer is located at a position lower than that of the first layer on the sacrifice layer.

9. The method for manufacturing a liquid ejection head according to claim 1, wherein the region surrounds the portion to which the etching liquid or the etching gas is reached.

10. The method for manufacturing a liquid ejection head according to claim 9, wherein a plurality of the regions surrounds the portion to which the etching liquid or the etching gas is reached.

* * * * *